United States Patent [19]

Hanke et al.

[11] 4,060,785

[45] Nov. 29, 1977

[54] ENCLOSING STRUCTURE FOR A HIGH VOLTAGE ELECTRIC FUSE

[75] Inventors: Kenneth Earl Hanke, Atlanta; Ned Rees, Tucker, both of Ga.

[73] Assignee: Kearney-National Inc., Atlanta, Ga.

[21] Appl. No.: 722,361

[22] Filed: Sept. 13, 1976

[51] Int. Cl.[2] ..... H01H 85/02

[52] U.S. Cl. ..... 337/201; 337/202

[58] Field of Search ..... 337/186, 187, 224, 188, 337/202, 201, 414

[56] References Cited

U.S. PATENT DOCUMENTS

| | | | |
|---|---|---|---|
| 3,678,432 | 7/1972 | Boliver | 337/201 |
| 3,686,603 | 8/1972 | Lockie et al. | 337/224 X |
| 3,829,810 | 8/1974 | Giegerich | 337/202 |

*Primary Examiner*—George Harris

*Attorney, Agent, or Firm*—Walter M. Rodgers; Walter A. Rodgers

[57] ABSTRACT

An enclosing structure for an electric fuse having a fusible element disposed within a tubular casing of insulating material and interconnected at its ends with terminals mounted on the casing ends comprises an elongated tubular enclosure formed of insulating and semiconducting material and disposed about the fuse with its inner surface in heat transferring surface contacting relation therewith and a rigid metallic heat absorbing sleeve imbedded in the elongated enclosure to absorb heat therefrom and to impart a degree of mechanical strength thereto. Semiconducting sleeves which form parts of the tubular enclosure include an outer sheath which is grounded and inner sleeve elements arranged so as to isolate the fuse and the contacts of the fuse enclosing structure thereby to inhibit corona discharge from the conducting parts.

15 Claims, 13 Drawing Figures

ENCLOSING STRUCTURE FOR A HIGH VOLTAGE ELECTRIC FUSE

Experience with underground distribution systems has indicated that effective and economical protection for such systems and particularly for underground distribution transformers can be provided by means of current limiting fuses. It is the practice to mount such fuses in series with the high voltage windings of distribution transformers. In order to properly mount such fuses in the high voltage circuits of distribution transformers, it is vital that a suitable fuse enclosure be provided which efficiently dissipates heat generated in the fuse in order to avoid undesirable circuit interruption due to the accumulation of heat under normal operating conditions. Since underground circuits are provided with an external grounded sheath, it is vital that the conducting elements of current limiting fuses and of their enclosing structures be adequately shielded so as to prevent damage to the enclosing structure itself which necessarily would result in the absence of proper shielding for the conducting parts.

According to this invention an enclosing structure for a high voltage fuse is provided which effectively dissipates heat generated by the fuse and which also is adequately shielded so as to prevent undesired emission of corona from the conductive parts especially those which are characterized by sharp edges. Toward these ends, an enclosing structure is provided which comprises an enclosure formed of pliable insulating and semiconductive sleeves appropriately interspersed so that the insulatmg sleeves isolate the fuse terminals when the fuse operates and so that the semiconducting sleeves inhibit discharge of corona, and a rigid metallic heat absorbing sleeve is imbedded in the fuse enclosing structure to dissipate heat and also to impart a measure of mechanical strength to the enclosing structure.

For a better understanding of the invention reference may be had to the following detailed description taken in conjunction with the accompanying drawings in which FIG. 1 is an exploded view showing the protected fuse and the two end sections of the enclosing structure formed according to the invention;

Figure 1:
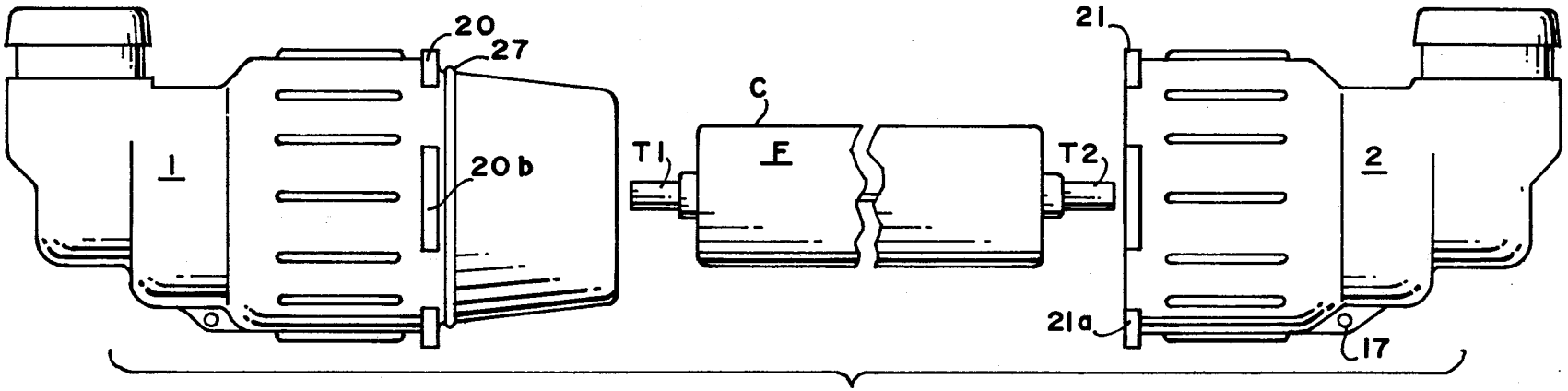

In FIG. 1 a fuse F is shown between the two exploded end sections designated by the numerals 1 and 2.

Figure 2:
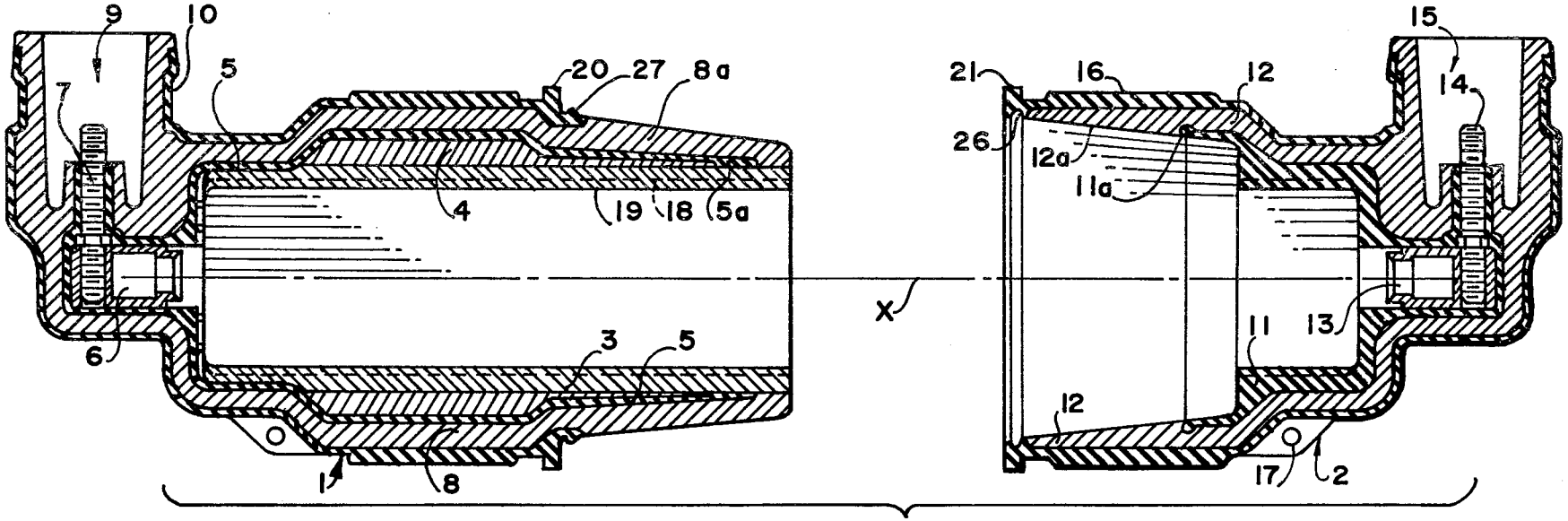
FIG. 2 is a cross sectional view of the two end sections formed according to the invention.

In FIG. 2 the fuse F is omitted for clarity. As is best shown in FIG. 2, end section 1 comprises an inner sleeve 3 of insulating material and a metal sleeve 4 is disposed about a portion of the inner insulating sleeve 3 and preferably is formed of aluminum although other metals could be used if desired. Inner sleeve 3 is disposed in close surface contact with the insulating casing C of the fuse F so that heat imparted to insulating sleeve 3 is conducted to metal sleeve 4 and these elements cooperate to form a "heat sink" by which heat is dissipated from the fuse F.

Disposed about the insulating sleeve 3 and the metal sleeve 4 is a sleeve 5 formed of semiconducting material which not only encases a major portion of the insulating sleeve 3 but also surrounds the contact socket 6 and constitutes a corona shield for one end of the fuse and the contact socket 6 and associated structure including the lower part of conducting stud 7.

Disposed about semiconducting shield 5 is a sleeve of insulating material 8 which surrounds the sleeves 3, 4 and 5 and also forms a well generally designated by the numeral 9 which may receive the separable insulated connector system or cable adapter. Disposed about insulating sleeve 8 is a semiconducting sheath 10.

At the other end of the enclosing structure, the end section 2 comprises an inner sleeve 11 of semiconducting material about which a sleeve 12 of insulating material is formed. Contact socket generally designated by the numeral 13, conducting stud 14, and semiconducting sleeve 11 are surrounded by the insulating sleeve 12. Sleeve 12 also defines a bushing well generally designated by the numeral 15 which as explained in connection with bushing well 9 may receive a separable enclosed connector system or cable adapter. Disposed about insulating sleeve 12 is a sleeve 16 formed of semiconducting material. An aperture 17 is formed in semiconducting sleeve 16 and may conveniently serve as a means of connecting the sheath 16 to ground by means of a suitable conductor inserted through the aperture 17.

In order to mount the fuse F within the two end sections 1 and 2, the fuse is manipualted so that its terminal T1 is inserted into the contact socket 6 simultaneously with the insertion of the fuse casing inside the insulating sleeve 3 so that the sleeve 3 is in surface contact with the casing C of fuse F. Thereafter end section 2 is manipulated into enveloping relationship with respect to the right hand end of end section 1 so as to cause the terminal T2 of fuse F to enter the contact socket 13 simultaneously with the envelopment of the right hand end of casing C by semiconducting sleeve 11. With the parts so assembled, the structure as seen from above appears as shown in FIG. 3.

Figure 4:
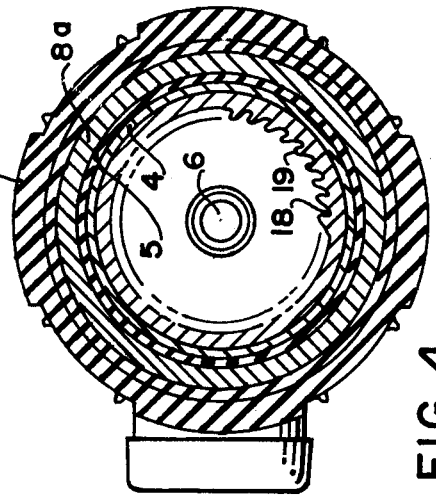
FIG. 4 is a cross sectional view taken along the line designated 4—4 in FIG. 3.
Figure 5:
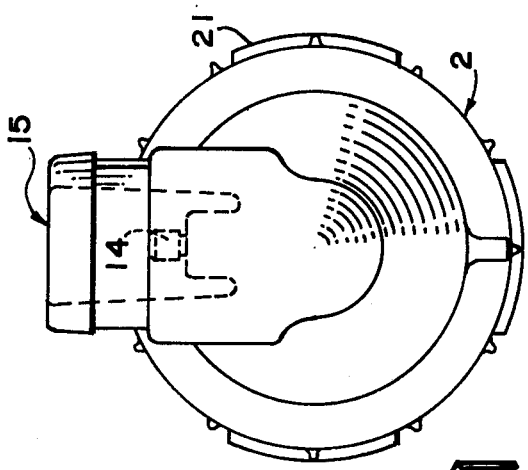
FIG. 5 is an end view of the structure shown in FIG. 3.

In order to facilitate the efficient conduction of heat from the casing C of fuse F to the insulating sleeve 3 and to the semiconducting sleeve 11, sleeves 3 and 11 are provided with longitudinal troughs best seen in FIG. 4 and designated by the numeral 18 between which a plurality of ribs designated by the numeral 19 are formed. From FIG. 4 it is apparent that insertion of the fuse casing into the insulating sleeve 4 and the semiconducting sleeve 11 causes the ribs 19 to flex and form an interference fit with the exterior surface of casing C in close surface contact so as to facilitate transfer of heat by conduction from the fuse outwardly to the enclosing structure. Furthermore since the metallic sleeve 4 closely envelopes insulating sleeve 3, dissipation of heat is further facilitated due to the high conductivity of the metal sleeve 4.

Figure 11:
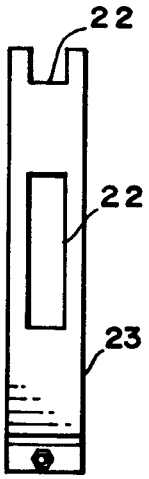
FIG. 11 is a side view of a clamping band used to secure the inner ends of the two end sections of the fuse enclosures together.
Figure 12:
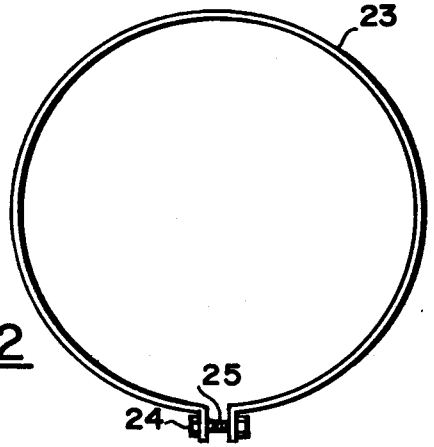
FIG. 12 is an end view of the clamping ring shown in FIG. 11.

When the end sections 1 and 2 are assembled with the fuse F disposed therein, the surface 12*a* of sleeve 12 is disposed in enveloping relationship to the part 8*a* of sleeve 8. Furthermore radially protruding peripheral projections 20 which are formed as integral parts of sleeve 10 are disposed immediately adjacent radially protruding peripheral projections 21 which form integral parts of sleeve 16. These projections are received within clamping apertures 22 formed in spaced relation about the periphery of clamping ring 23 as best shown in FIG. 11. Thus with the parts in assembled condition and with the nut 24 tightened on bolt 25 as shown in FIG. 12, clamping ring 23 aids in holding end sections 1 and 2 together because the radially protruding peripheral projections 20 and 21 are disposed within the clamping apertures 22 of ring 23.

Figure 3:
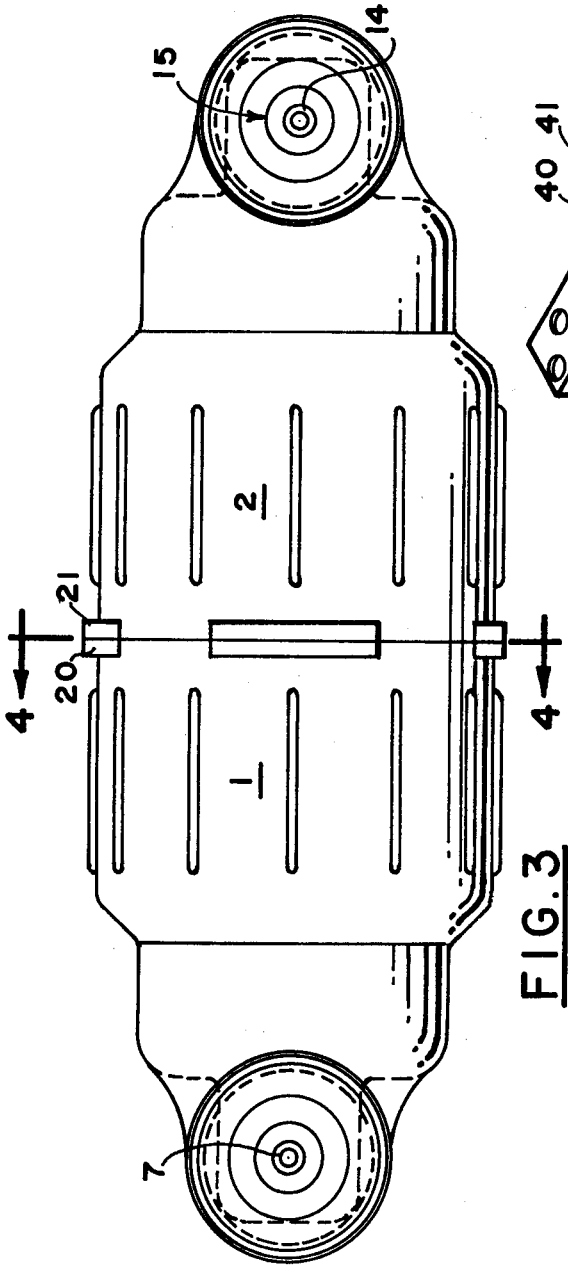
FIG. 3 is an exterior view of the assembled structure as seen from above.

While for most applications of the invention the end sections 1 and 2 will be arranged as shown in FIG. 3, it may be desirable to rotate one end section relative to the other about the longitudinal axis X. Thus peripheral projection 21*a* could be disposed alongside some other projection such as 20*b* if desired. In such an arrangement stud 14 is disposed in angular relation to stud 7.

The assembled structure is rendered water tight by the telescoping fit of surface 12*a* about surface 8*a* and, in addition, a peripheral groove 26 is formed in the semiconducting sleeve 12*a* and a suitable rib designated by the numeral 27 is formed as an integral part of sleeve 10. The rib 27 and groove 26 serve to secure sections 1 and 2 together.

When the end sections are assembled as described, the shielding of the fuse F and contact sockets 6 and 13 is completed by the semiconducting sleeve 5, the inner end 5*a* of which is telescopically disposed within the inner end 11*a* of the semiconducting sleeve 11. The innermost end 11*a* of sleeve 11 is radially spaced outwardly from the inner end 5*a* of semiconducting sleeve 5 so that when the fuse blows these parts are isolated from each other by the inner end 8*a* of insulating sleeve 8 which is interposed therebetween. Since the parts are telescopically related, the emission of corona is completely shielded as is well known.

Figure 9:
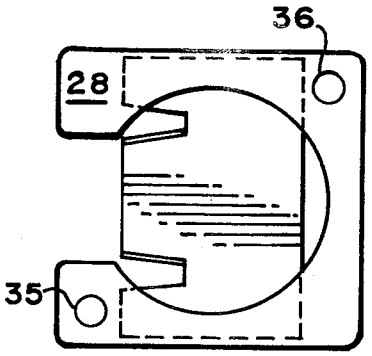
FIG. 9 is a view of a mounting bracket which forms a component of the mounting structure.
Figure 10:
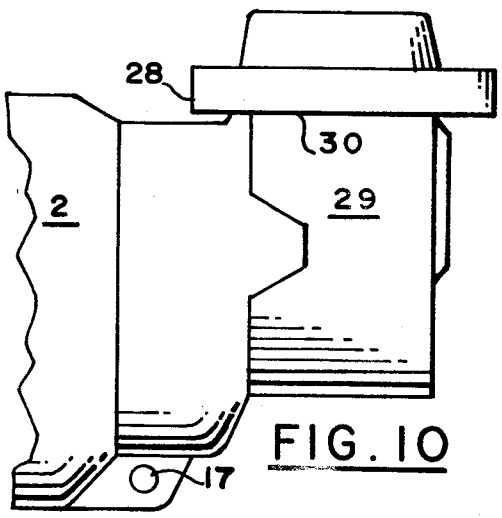
FIG. 10 is a view of one end of the fuse enclosing structure which shows the manner in which the mounting bracket is related with the fuse enclosure.
Figure 8:
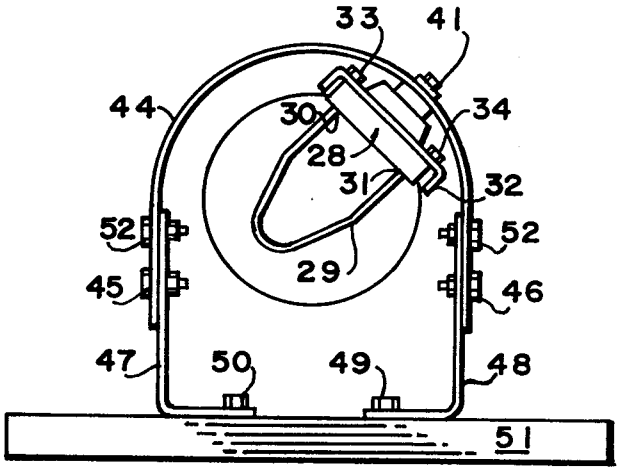
FIG. 8 is an end view of the structure shown in FIG. 7.
Figure 7:
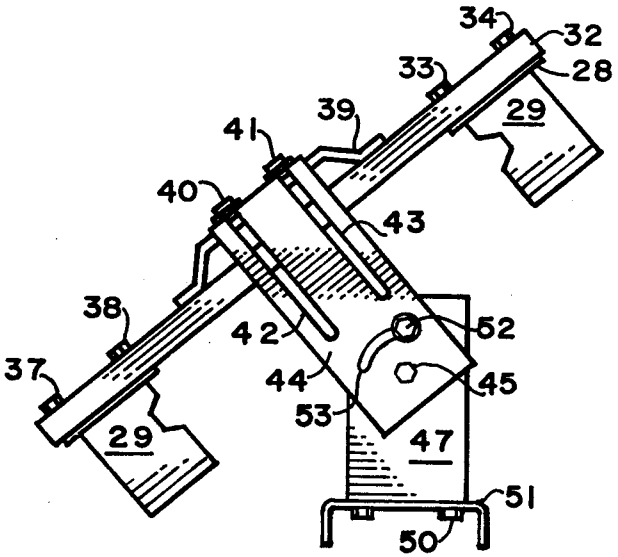
FIG. 7 is a side view of the fuse mounting structure shown in FIG. 6 but with the enclosure structure omitted.

The structure as described above is somewhat pliable or flexible since the enclosing structure includes elastomeric sleeves which of course are not structurally rigid. In order to impart a degree of mechanical strength to the enclosing structure, a rigid mounting bracket as best shown in FIGS. 8, 9 and 10 is provided. This bracket is a single casting and comprises a collar 28 formed of metal and a metallic loop 29 which is secured at its ends 30 and 31 to collar 28. When assembled, the loop 29 is disposed about and underneath the well 15 and the collar 28 is disposed in encircling enveloping relation about the well 15. Mounting plate 32 as best shown in FIGS. 7 and 8 is secured by suitable bolts 33 and 34 which are inserted in threaded apertures 35 and 36 formed in collar 28.

It will be understood that a similar collar such as 28 and its associated loop 29 are secured to the opposite end of mounting plate 32 by means of bolts 37 and 38 which are inserted in suitable threaded apertures such as 35 and 36 as best shown in FIG. 9. With the mounting collars 28 and their associated loops 29 disposed about the wells 9 and 15 and with this structure secured to the mounting plate 32, the entire structure is mechanically strong according to one feature of the invention.

Figure 13:
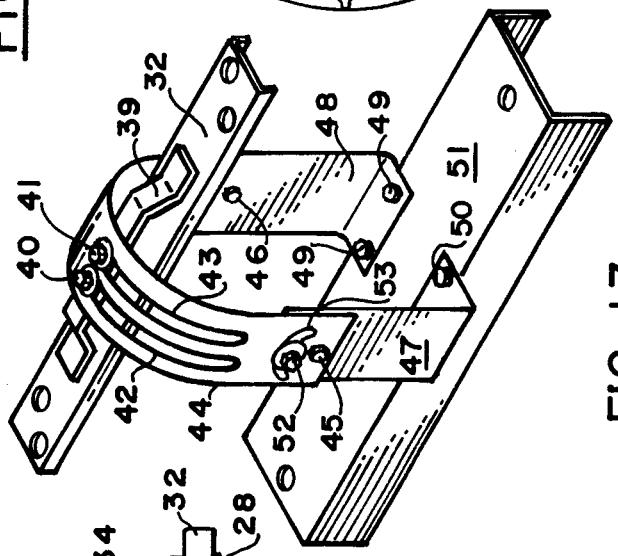
FIG. 13 is a perspective view of the entire mounting structure but with the fuse enclosure structure omitted for clarity.
Figure 6:
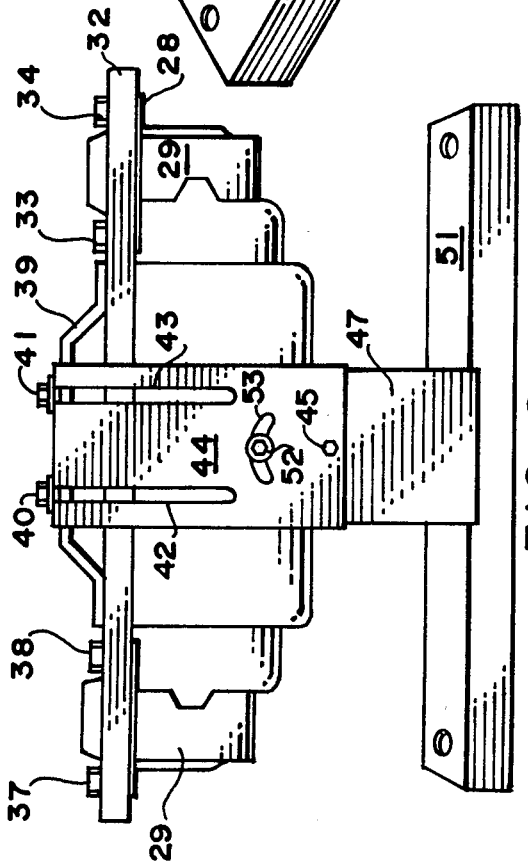
FIG. 6 is a side view of the structure shown in FIG. 3 but which includes the mounting structure for the fuse enclosure.

In order to provide for mounting the enclosing structure in horizontal or vertical positions or in some intermediate position, a universal type mounting arrangement is provided according to another facet of the invention. As is best shown for example in FIG. 13 a cross pad 39 is suitably secured at its ends to the mounting plate 32 by welding or otherwise and a pair of bolts 40 and 41 are threaded into the pad 39 and are disposed in slots 42 and 43 respectively which are formed in arcuate mounting ring 44 which in turn is pivoted at 45 and 46 to the supporting base plates 47 and 48 which in turn are secured by suitable means 49 and 50 to base plate 51. Swinging movement of arcuate mounting element 44 about pivots 45 and 46 may be effected by simply loosening the clamping bolt 52 which rides in arcuate slot 53. When a suitable attitude is reached, the bolt 52 is simply tightened and the structure thus remains in some desired orientation such for example as that shown in FIG. 7. In order to swing the enclosing structure about its longitudinal axis, the clamping bolts 40 and 41 are loosened and the structure rotated to some position such for example as that indicated in FIG. 8. Thereafter the clamping bolts 40 and 41 are tightened to hold the structure securely in that position.

The embodiments of the invention in which an exclusive property or privilege is claimed are defined as follows:

1. An enclosing structure for an electric fuse having a fusible element disposed within a tubular casing of insulating material and interconnected at its ends with terminals mounted on the casing ends, said enclosing structure comprising an elongated enclosure formed of insulating and semiconducting material and disposed about said tubular casing and with its inner surface in heat transferring surface contacting relation therewith, and a rigid metallic heat absorbing sleeve embedded in said elongated enclosure for absorbing heat therefrom and for imparting a degree of mechanical strength thereto.

2. An enclosing structure according to claim 1 wherein said elongated enclosure comprises a pair of telescopically related end sections.

3. An enclosing structure according to claim 2 wherein said metallic heat absorbing sleeve forms a part of the inner one of said end sections.

4. An enclosing structure according to claim 3 wherein a sleeve of semiconductive elastomeric material is disposed about said heat absorbing sleeve.

5. An enclosing structure according to claim 2 wherein each of said end sections includes a fuse contact socket embedded therein and wherein a sleeve of semiconductive elastomeric material is formed in each of said sections and disposed about each of said fuse contact sockets.

6. An enclosing structure according to claim 5 wherein a sleeve of insulating material is disposed about each of said sleeves of semiconducting elastomeric material.

7. An enclosing structure according to claim 6 wherein an outer sheath of semiconducting elastomeric material is disposed about each of said sleeves of insulating material.

8. An enclosing structure according to claim 7 wherein each of said outer sheaths is formed with a plurality of radially protruding peripheral projections and wherein a clamping band having a plurality of apertures for receiving said projections is disposed thereabout to aid in holding said end sections together.

9. An enclosing structure according to claim 7 wherein the inner ends of said outer sheaths are arranged in telescoping relationship to each other.

10. An enclosing structure for an electric fuse having a fusible element disposed within a tubular casing of insulating material and interconnected at its ends with terminals mounted on the casing ends, said enclosing structure comprising an elongated tubular enclosure formed of insulating and semiconducting material and disposed about said tubular casing and having a plurality of longitudinal troughs formed along the inner surface thereof and defining a plurality of ribs therebetween, said ribs being flexible and in heat transferring surface contacting relation with the outer surface of the fuse casing.

11. An enclosure according to claim 10 wherein said enclosing structure comprises a pair of end sections having telescopically related inner ends and wherein an inner sleeve of insulating material forms the inner surface of one of said end sections and wherein a sleeve of semiconducting material forms the inner surface of the other of said end sections.

12. An enclosing structure according to claim 11 wherein a plurality of longitudinal troughs are formed in said sleeve of semiconducting material to define a plurality of ribs therebetween, said ribs being flexible and in heat transferring surface contacting relation with the outer surface of the fuse casing.

13. An enclosing structure for an electric fuse having a fusible element disposed within a tubular casing of insulating material and interconnected at its ends with terminals mounted on the casing ends, said enclosing structure comprising a pair of end sections formed of pliable material and having telescopically related inner ends and each including a transversely projecting bushing well at its outer end, a rigid mounting bracket disposed about at least a part of each of said bushing wells, a rigid mounting plate disjointably secured near its ends to said mounting brackets to impart mechanical reinforcement to said enclosing structure and to provide mounting means therefor, and an arcuate mounting ring pivotally mounted at its ends on a mounting base, said mounting ring and said mounting plate being disjointably coupled together in such manner as to accommodate limited universal movement of said structure.

14. Structure according to claim 13 wherein said bushing wells are constructed of elastomeric material.

15. An enclosing structure according to claim 13 wherein said arcuate mounting ring includes a slot, and wherein a clamping bolt is threadedly related with a part of said mounting plate and disposed within said slot.

* * * * *